US008522657B2

(12) United States Patent
Oohama

(10) Patent No.: US 8,522,657 B2
(45) Date of Patent: Sep. 3, 2013

(54) SLIDE-TYPE CUTTING MACHINE

(75) Inventor: Shinji Oohama, Hiroshima (JP)

(73) Assignee: Ryobi Ltd., Hiroshima (JP)

( * ) Notice: Subject to any disclaimer, the term of this patent is extended or adjusted under 35 U.S.C. 154(b) by 702 days.

(21) Appl. No.: 12/681,893

(22) PCT Filed: Aug. 18, 2008

(86) PCT No.: PCT/JP2008/064709

§ 371 (c)(1),
(2), (4) Date: Apr. 7, 2010

(87) PCT Pub. No.: WO2009/047945

PCT Pub. Date: Apr. 16, 2009

(65) Prior Publication Data

US 2010/0212467 A1 Aug. 26, 2010

(30) Foreign Application Priority Data

| | | |
|---|---|---|
| Oct. 12, 2007 | (JP) | 2007-266791 |
| Oct. 19, 2007 | (JP) | 2007-273017 |
| Nov. 1, 2007 | (JP) | 2007-284922 |
| Nov. 5, 2007 | (JP) | 2007-286948 |
| Nov. 15, 2007 | (JP) | 2007-296853 |

(51) Int. Cl.
*B27B 5/065* (2006.01)

(52) U.S. Cl.
USPC ..... 83/471.3; 83/487

(58) Field of Classification Search
USPC ..... 83/483, 477, 477.1, 471.2, 471.3, 83/467.1, 484–490
See application file for complete search history.

(56) References Cited

U.S. PATENT DOCUMENTS

| | | | | |
|---|---|---|---|---|
| 1,644,887 | A * | 10/1927 | Mansfield | 83/473 |
| 2,007,563 | A * | 7/1935 | De Koning | 83/486.1 |
| 2,295,897 | A * | 9/1942 | Gillespie | 74/526 |
| 2,708,952 | A * | 5/1955 | Blackwell | 83/471.3 |
| 3,910,142 | A * | 10/1975 | Jureit et al. | 83/74 |

(Continued)

FOREIGN PATENT DOCUMENTS

| | | |
|---|---|---|
| JP | 07-276135 | 10/1995 |
| JP | 09-300301 | 11/1997 |

(Continued)

OTHER PUBLICATIONS

Translation of Toshiaki JP-11-156801.*

(Continued)

*Primary Examiner* — Sean Michalski
(74) *Attorney, Agent, or Firm* — Young & Thompson

(57) ABSTRACT

A slide-type cutting machine ensures safer operation of cutting wood or the like and can be housed in a compact state. A linear guide unit 3 includes a slide shaft 33 moving in a direction perpendicular to the moving direction of a cutting section 4, a first slide holder 31 for guiding the movement of the slide shaft 33, and a second slide holder 34 located at a lower end of the slide shaft 33 and for restricting the movement of the slide shaft 33 by abutting against the first slide holder 31. A linkage element 5 includes a first link 51 having one end connected to the cutting section 4 and the other end connected to the second slide holder 34, and a second link 52 having one end connected to the first slide holder 31 and the other end connected to the first link 51.

16 Claims, 6 Drawing Sheets

(56) References Cited

U.S. PATENT DOCUMENTS

| | | | | |
|---|---|---|---|---|
| 4,036,093 | A * | 7/1977 | Thorsell | 83/471.3 |
| 4,531,440 | A * | 7/1985 | Lucky | 83/471.2 |
| 4,553,462 | A * | 11/1985 | Silken | 83/471.3 |
| 4,587,875 | A * | 5/1986 | Deley | 83/471.3 |
| 4,869,142 | A * | 9/1989 | Sato et al. | 83/467.1 |
| 5,082,996 | A * | 1/1992 | Takahashi et al. | 200/401 |
| 5,138,920 | A * | 8/1992 | Mayfield | 83/471.2 |
| 5,148,732 | A * | 9/1992 | Striebig | 83/863 |
| 5,365,812 | A * | 11/1994 | Harnden | 83/34 |
| 5,839,339 | A * | 11/1998 | Sasaki et al. | 83/471.3 |
| 5,950,514 | A * | 9/1999 | Benedict et al. | 83/397 |
| 5,950,531 | A * | 9/1999 | Uchiyama | 100/353 |
| 5,988,030 | A * | 11/1999 | Hada et al. | 83/176 |
| 6,021,700 | A * | 2/2000 | Garuglieri | 83/468.1 |
| 6,047,576 | A * | 4/2000 | Lanigan et al. | 70/279.1 |
| 7,059,228 | B2 * | 6/2006 | Chang | 83/471.2 |
| 7,228,773 | B2 * | 6/2007 | Powell | 83/100 |
| 7,387,056 | B2 * | 6/2008 | Higuchi | 83/483 |
| 7,669,510 | B2 * | 3/2010 | Imamura et al. | 83/471.3 |
| 8,430,005 | B2 * | 4/2013 | Gass et al. | 83/62.1 |
| 2001/0008098 | A1 * | 7/2001 | Dibbern et al. | 83/471.3 |
| 2003/0024364 | A1 * | 2/2003 | Chang | 83/471.2 |
| 2003/0024366 | A1 * | 2/2003 | Hollinger et al. | 83/473 |
| 2006/0230902 | A1 * | 10/2006 | Oberheim | 83/522.15 |
| 2006/0266184 | A1 * | 11/2006 | Hetcher et al. | 83/471.3 |
| 2008/0079300 | A1 * | 4/2008 | Kojima et al. | 297/311 |
| 2008/0210074 | A1 * | 9/2008 | Higuchi | 83/471.3 |
| 2010/0269661 | A1 * | 10/2010 | Cox et al. | 83/471.3 |
| 2012/0055310 | A1 * | 3/2012 | Kani et al. | 83/483 |

FOREIGN PATENT DOCUMENTS

| | | |
|---|---|---|
| JP | 11-058302 | 3/1999 |
| JP | 11-156801 | 6/1999 |
| JP | 2006-069057 | 3/2006 |
| JP | 2006-198868 | 8/2006 |

OTHER PUBLICATIONS

International Search Report—PCT/JP2008/064709—Oct. 7, 2008.

* cited by examiner

SLIDE-TYPE CUTTING MACHINE

TECHNICAL FIELD

The present invention relates to a slide-type cutting machine having a cutting section linearly move parallel to a base.

BACKGROUND ART

Cutting machines for cutting wood by rotating a blade such as a circular saw blade are known conventionally. Some of those have a slide mechanism for sliding the blade in parallel with the base, on which wood or the like is placed, so as to enable cutting of the wood even in a long cut length.

Patent Document 1: Japanese Patent Application Laid-open No. H11-156801

Patent Document 2: Japanese Patent Application Laid-open No. H09-300301

Patent Document 3: Japanese Patent Application Laid-open No. H07-276135

Patent Document 4: Japanese Patent Application Laid-open No. 2006-198868

Patent Document 5: Japanese Patent Application Laid-open No. H11-58302

The slide-type cutting machine described in the Patent Document 1 is provided with a linkage means including a first link having one end connected to a cutting section having a blade and the other end connected to a movable section, respectively, and a second link having one end connected to the first link and the other end connected to a linear guide unit.

In the slide-type cutting machine described in the Patent Document 1 having such structure, the cutting section including the blade moves toward one direction while being guided by the linear guide unit including the movable section, which moves toward a direction perpendicular to the above direction, and therefore the guide unit can be prevented from projecting toward the moving direction of the blade, and is suitable for cutting operation in a narrow site.

The slide-type cutting machine described in the Patent Document 2 has a constant load spring disposed between a cutting machine body and a worktable, and resilience of the constant load spring is used for slide operation.

The slide-type cutting machine described in the Patent Document 2 having such structure permits automatic return to a predetermined position by resilience of the constant load spring at the time of releasing the sliding operation in the cutting machine body. Further, since the cutting machine is operated by a constant power during the sliding operation, it is possible to carry out sliding operation to an operation start position and feeding operation during cutting work also at a constant power, improving sliding operability.

The slide-type cutting machine described in the Patent Document 3 includes a support member disposed to be inclinable with respect to a base portion, a shaft passing through the base portion and the support member, a cum shaft lever passing through a hole formed in the shaft, the cum shaft lever rotatably mounted to the support member, and a circular saw blade mounted to the support member by means of a circular saw blade support member, wherein an eccentric cum portion is located in the hole of the shaft and the rotating operation of the cum shaft lever is controlled beside a circular saw plate.

The slide-type cutting machine described in the Patent Document 3 having such structure permits easy control of the tilt angle of the circular saw blade without increasing a weight of the machine.

The slide-type cutting machine described in the Patent Document 4 has a carry handle provided on the blade portion.

The slide-type cutting machine described in the Patent Document 4 having such structure permits easy carrying with the carry handle held by hand at the time of transportation.

The slide-type cutting machine described in the Patent Document 5 uses a pull spring as an auxiliary power decreasing means for decreasing a high operation power to move the circular saw in the horizontal direction. Further, this machine has a damper mechanism for preventing an abrupt movement of the saw blade when the circular saw is not held by hand.

The slide-type cutting machine described in the Patent Document 5 having such structure permits the circular saw to be moved horizontally without requiring a great power and prevents an abrupt movement of the saw blade even when the circular saw is not held by hand in use of the slide-type cutting machine.

DISCLOSURE OF THE INVENTION

Problem to be solved by the Invention

According to the conventional slide-type cutting machine described above, however, in the slide-type cutting machine of the Patent Document 1, when the blade is moved to the front of an operator from a far position, the linear guide unit and the linkage means are moved downward and therefore when the operator takes off the hand from the cutting section, the cutting section is moved to the near side (operator side) by the own weight of the linear guide unit and the linkage means. Moreover, though the cutting section is provided with a guard, cut scraps or the like produced by cutting wood are stuck to a movable portion of the guard, sometimes obstructing normal operation of the guard. In such case, if the operator takes off the hand from the handle of the cutting section directly after finishing the cutting work, the cutting section would move toward the operator, inducing danger to the operator. Moreover, at the time of housing the slide-type cutting machine, it could be the most compact housing state if the blade is located at a far position from the operator (linear guide unit side). However, in the cutting machine of the Patent Document 1, if the cutting section is moved to such a position far from the operator, the linear guide unit is projected upward and therefore housing the cutting machine needs a large space. Moreover, in the slide-type cutting machine of the patent Document 2, since the slide mechanism is forced by a spiral load spring, an additional member to drive the cutting machine is needed, thus increasing cost and troublesome assembling operation.

According to the above structure of the conventional slide type cutting machine, in the slide-type cutting machine of the Patent Document 1, since the linear guide unit and the linkage means are located rearward of the blade, when the cutting section is located at a position near the linear guide unit, the linear guide unit is projected upward and overlaps with the cutting section. This location causes a problem in disposition of a dust collector. Moreover, in the slide-type cutting machine of the Patent Document 1, since the tilt angle of the cutting section is fixed, the blade cannot be tilted against the work plane on which a workpiece is placed and therefore the workpiece cannot be cut with a desired angle. Moreover, in the slide-type cutting machine of the Patent Document 3, since the support member on which a tilting position controlling mechanism and a tilting stopper are disposed is substantially circular-shaped and therefore some size of space is needed to dispose such tilting mechanism, causing problem in decreasing the size of the slide type cutting machine.

According to the above structure of the conventional slide type cutting machine, in the slide-type cutting machine of the Patent Document 1, the slide-type cutting machine cannot be held in a good state when it is transported, involving great problem in transporting the machine. In addition, since the cutting machine of the Patent Document 1 does not have the tilting mechanism, the blade cannot be tilted to cut the workpiece obliquely. In the slide-type cutting machine of the Patent Document 4, the carry handle is mounted to the saw portion. At the time of carrying the slide-type cutting machine by holding the handle, both a slide mechanism for horizontally moving the saw portion and a swing mechanism for vertically moving the saw portion have to be fixed, involving troublesome preparation before carrying the cutting machine.

Moreover, according to the above structure of the conventional slide type cutting machine, in the cutting machine of Patent Document 1, a stopper S as a rod-shape member is used to halt the movement of the linear guide unit for the link not to be moved at the time of housing the cutting machine. More specifically, the linear guide unit includes the fix portion and the movable portion, the movement of which is fixed by using the stopper S so that the linear distance between the fix portion and the movable portion becomes the greatest. As having such structure, the stopper S becomes long, involving troublesome operation at the time of securing the linear guide unit.

Moreover, as mentioned above, the stopper S has such a long shape, involving a problem of how and where the stopper S is safe-kept when it is not in use, in other words, when the slide-type cutting machine is in use.

Moreover, according to the above structure of the conventional slide type cutting machine, in the cutting machine of Patent Document 1, the linear guide unit (slide shaft) and the linkage means (link) are moved downward when the saw portion is moved from the far position toward the near position of the operator. The linear guide unit (slide shaft) and the linkage means (link) have a heavy weight and when the operator takes off the hand from the cutting machine, the saw portion is moved nearer in front of the operator. Therefore, at the instant when the operator takes off the hand from the handle after finishing cut operation of wood piece, sometimes suddenly the saw portion runs close to the operator.

Moreover, in the cutting machine of the Patent Document 5, since the cutting machine needs the tensile spring as an operation power reducing means to assist the circular saw to move in the horizontal direction, involving problems of a high parts count, troublesome assembling operation, cost reduction and so on.

It is therefore an object of the invention to overcome the above problems and provide any of the slide-type cutting machines, which are:

a slide-type cutting machine that ensures safer operation for cutting wood or the like and permits compact housing thereof;

a slide-type cutting machine that enables efficient collection of cut scraps or the like scattered from workpiece during working operation, has a dust collector disposed not to interfere with a linear guide unit and a linkage means when the cutting section is sliding, and makes it possible to cut the workpiece with a desired cut angle without increasing the size of the slide-type cutting machine itself;

a slide-type cutting machine that is easily carried with a small number of securing positions and makes it possible to tilt the blade section to perform slant cutting;

a slide-type cutting machine that makes it possible to easily fix the linear guide unit when the cutting machine is housed and is designed not to lose the stopper; and a slide-type cutting machine that is comprised of a low parts count and prevents the main body and the saw blade from an abrupt movement even when the operator takes off hand from the handle during the operation.

Means for solving the Problem

The invention is described below. To be noted, although the reference numbers in the accompanying drawings are added in the description for easier understanding of the invention, the invention is not restricted by the embodiments shown in the drawings.

A slide-type cutting machine 1 according to the invention includes: a base 2 having a plane 21 on which a workpiece is placed; a linear guide unit 3 mounted to the base 2; and a linkage means 5 mounted to a cutting section 4 having a blade 41*a*, wherein the linear guide unit 3 and the linkage means 5 constitute a Scott-Russell mechanism in cooperation with each other and guide a linear movement of the cutting section 4. The slide-type cutting machine is characterized in that the linear guide unit 3 includes a slide shaft 33 that moves in a direction perpendicular to the moving direction of the cutting section 4, a first slide holder 31 for guiding the movement of the slide shaft 33, and a second slide holder 34 located at a lower end of the slide shaft 33 and for restricting the movement of the slide shat 33 by abutting against the first slide holder 31, and the linkage means 5 includes a first link 51 and a second link, the first link having one end connected to the cutting section 4 and the other end connected to the second slide holder 34, the second link 52 having one end connected to the first slide holder 31 and the other end connected to the first link 51.

Further, the slide-type cutting machine 1 of the invention may include an auxiliary link 53 having one end connected to the cutting section 4 and the other end connected to the second slide holder 34.

Further, the slide-type cutting machine 1 of the invention may include a slide stopper 35 disposed on the upper end of the slide shaft 33 and for restricting the movement of the slide shaft 33 by abutting against the first slide holder 31.

Further, in the slide-type cutting machine 1 of the invention, at least one of the linear guide unit 3 and the linkage means 5 may be located at a offset position vertically off from a plane including a rotation plane of the blade 41*a*.

Further, in the slide-type cutting machine 1 of the invention, the linear guide unit 3 and the linkage means 5 may be disposed so as not to intersect the center axis of a dust collector 44 mounted to the cutting section 4.

Further, in the slide-type cutting machine 1 of the invention, the cutting section 4 may include a blade section 41 having the blade 41*a* and a holding section 42 that connects the blade section 41 to the linkage means 5, and the holding section 42 may be provided with a carry handle 43.

Further, in the slide-type cutting machine 1 of the invention, the cutting section 4 may be secured to the linear guide unit 3.

Further, in the slide-type cutting machine 1 of the invention, a second cutting section fixing portion 32 provided on the linear guide unit 3 and a first cutting section fixing portion 46 provided at the cutting section 4 may be fixed by means of a fixing member 32*a* to halt the movement of the cutting section 4.

Further, in the slide-type cutting machine 1 of the invention, the fixing member 32*a* may be secured to the linear guide unit 3 not to be detachable.

Further, the slide-type cutting machine 1 of the invention may be provided with a plurality of links (51, 52, 53) including the second link 52, one end of which is connected to the first slide holder 31 and the other end of which is connected to the second link 51, and the plurality of links 51, 52, 53 have a link hole 54 and are connected to each other with a shaft 56 passing through the link hole 54, and at least one of the plurality of links 51, 52, 53 may be provided on its inner periphery with a rotation control member 57 that is forced to the radial direction of the shaft 56.

Further, in the slide-type cutting machine 1 of the invention, the rotation control member 57 may be formed of silicon rubber.

Further, in the slide-type cutting machine 1 of the invention, the rotation control member 57 may be forced by an elastic body 57*a*.

Effect Of The Invention

According to the slide-type cutting machine of the invention, since the second holder disposed at the lower end of the slide shaft and the linkage means are linked to each other, when the operator takes off the hand from the handle after cutting operation, the slide shaft and the second slide holder move downward by own weight thereof. Then, ganged with the movement of the slide shaft and the second slide holder, the linkage means causes the cutting section to move to the side of the linear guide unit, namely, the cutting section does not move toward the operator, thus ensuring safety of the operator in cutting wood or the like. Furthermore, in the slide-type cutting machine of the invention, as mentioned above, the cutting section is stationed naturally at a position near side of the linear guide unit after moving there and in this condition, the slide shaft, which serves as the linear guide unit, projects downward. Therefore, it is possible to house the cutting machine without requiring a large space.

Further, since the slide-type cutting machine of the invention is provided with an auxiliary link having one end connected to the cutting section and the other end connected to the second slide holder, it is possible to prevent the cut section from rotating around the connecting portion between the first link and the cut section as a pivot, thus ensuring horizontally the linear movement of the cut section.

Furthermore, since the cutting machine of the invention has the slide stopper mounted to the upper end of the slide shaft so as to restrict the movement of the slide shaft by abutting against the first slide holder, it is possible to prevent the slide shaft from falling from the first slide holder when the cutting section moves to the side of the linear guide unit.

Still further, since at least one of the linear guide unit and the linkage means is vertically offset from a plane extending from a rotation plane of the blade, it is possible to prevent the linear guide unit and the linkage means from interfering with the dust collector if the linear guide unit projects upward. In addition, since the dust collector may be located at the rear of the cutting section, efficient dust collection can be ensured. Also, decreasing the size of the cutting machine can be attained.

Still furthermore, since the carry handle is secured to the holding section, which includes the cutting section to be guided by the Scott Russell mechanism, it is possible to carry the slide-type cutting machine without fixing the swing mechanism for vertically moving the blade section.

Still furthermore, since the link can be fixed at such a position that the linear distance between the linear guide unit and the cutting section becomes minimum, the housing state of the slide-type cutting machine can be improved with its housing space reduced. In addition, since the linear guide unit is secured using the fixing member, the fixing means can be minimized. Further, since the fixing member is mounted to the linear guide unit not to be detached, it is not necessary to take into consideration a housing spot and a housing manner for the fixing member not to be lost in use of the slide-type cutting machine.

Still furthermore, since the linkage means comprising the Scott Russell mechanism is provided with the rotation control member, it is possible to prevent an abrupt action of the linkage means, thus providing a safe slide-type cutting machine without a sudden movement of the cutting section toward the operator when the operator takes off the hand from the handle.

Still furthermore, since in the slide-type cutting machine of the invention, the rotation control member is mounted in a forced fashion between the link and the shaft, it is possible to constitute the rotation control mechanism by a low parts counts.

Still furthermore, since in the slide-type cutting machine of the invention, the rotation control member is forced using an elastic body, a power to control the rotation of the shaft can be easily changed by changing an elastic constant of the elastic body.

EXPLANATION OF REFERENCE NUMERALS

1: slide-type cutting machine, 2: base, 3: linear guide unit, 4: cutting section, 5: linkage means, 6: tilt mechanism, 21: work plane on which workpiece is placed, 31: first slide holder, 33: slide shaft, 34: second slide holder, 41: blade portion, 41*a*: blade, 41*b*: fixing bolt, 41*c*: handle, 41*d*: switch, 41*e*: blade surface, 42: holding section, 43: carry handle, 44: dust collector, 51: first link, 52: second link, 54: link hole, 53*a*: recess portion, 55*a*: reinforce portion, 56: shaft, 57: rotation control member, 57*a*: spring, 57*b*: adjustment screw

BEST MODE FOR CARRYING OUT THE INVENTION

Best modes for carrying out the invention are described below with reference to the drawings. To be noted, the embodiments below do not necessarily restrict the invention according the respective claims and do not necessarily require, as the means of solution, the combinations of the characteristics described in the embodiments.

Figure 1:
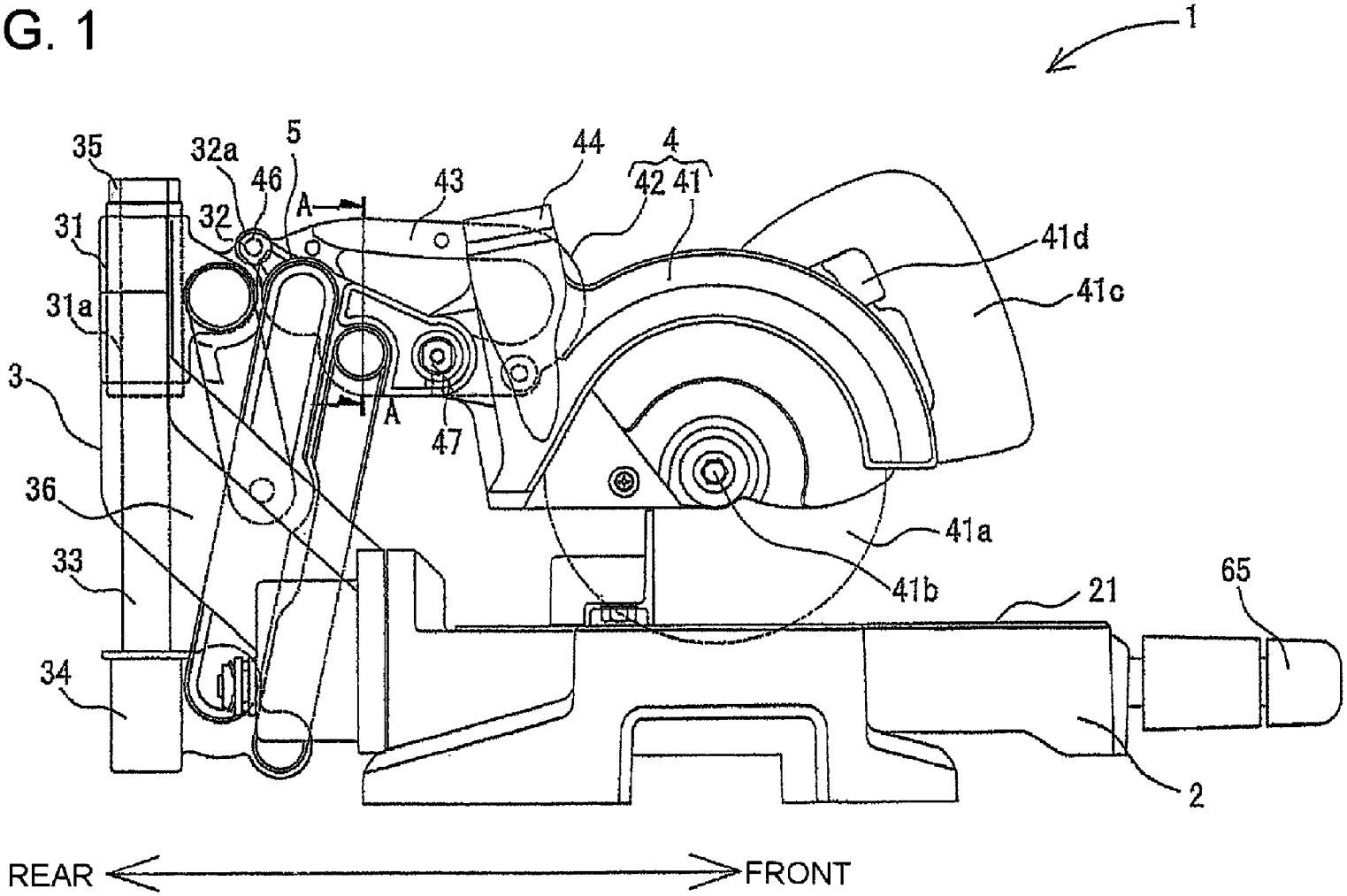
FIG. 1 is a side view showing the whole structure of the slide-type cutting machine.
Figure 2:
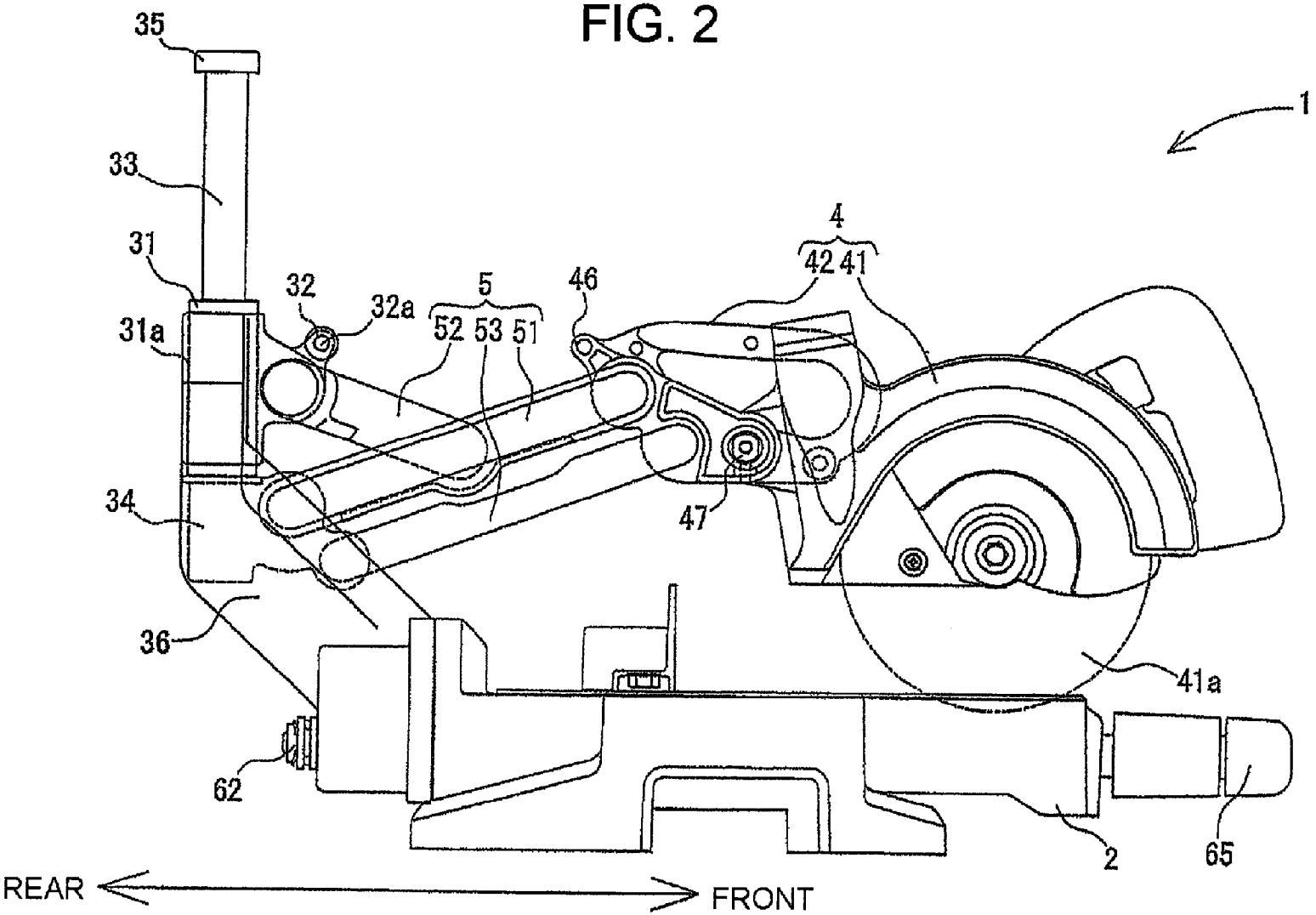
FIG. 2 is a side view showing a state in which the cutting section is moved to the operator's side.
Figure 3:
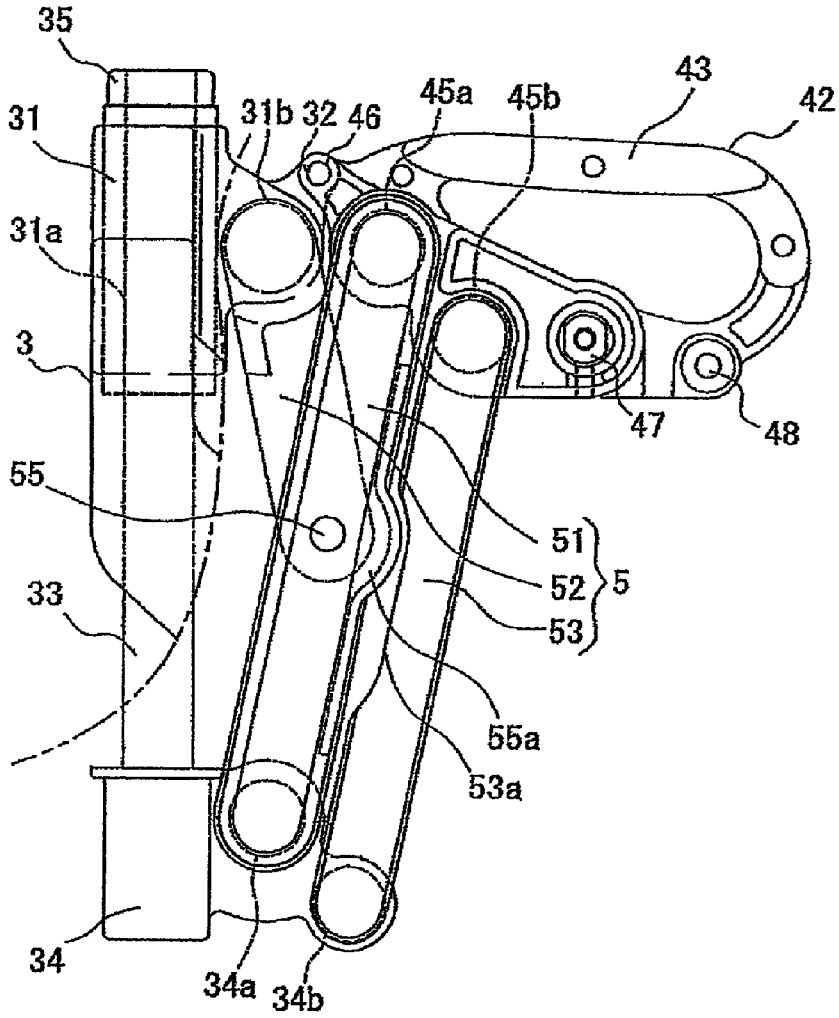
FIG. 3 is an enlarged view showing the linkage means of the slide-type cutting machine.
Figure 4:
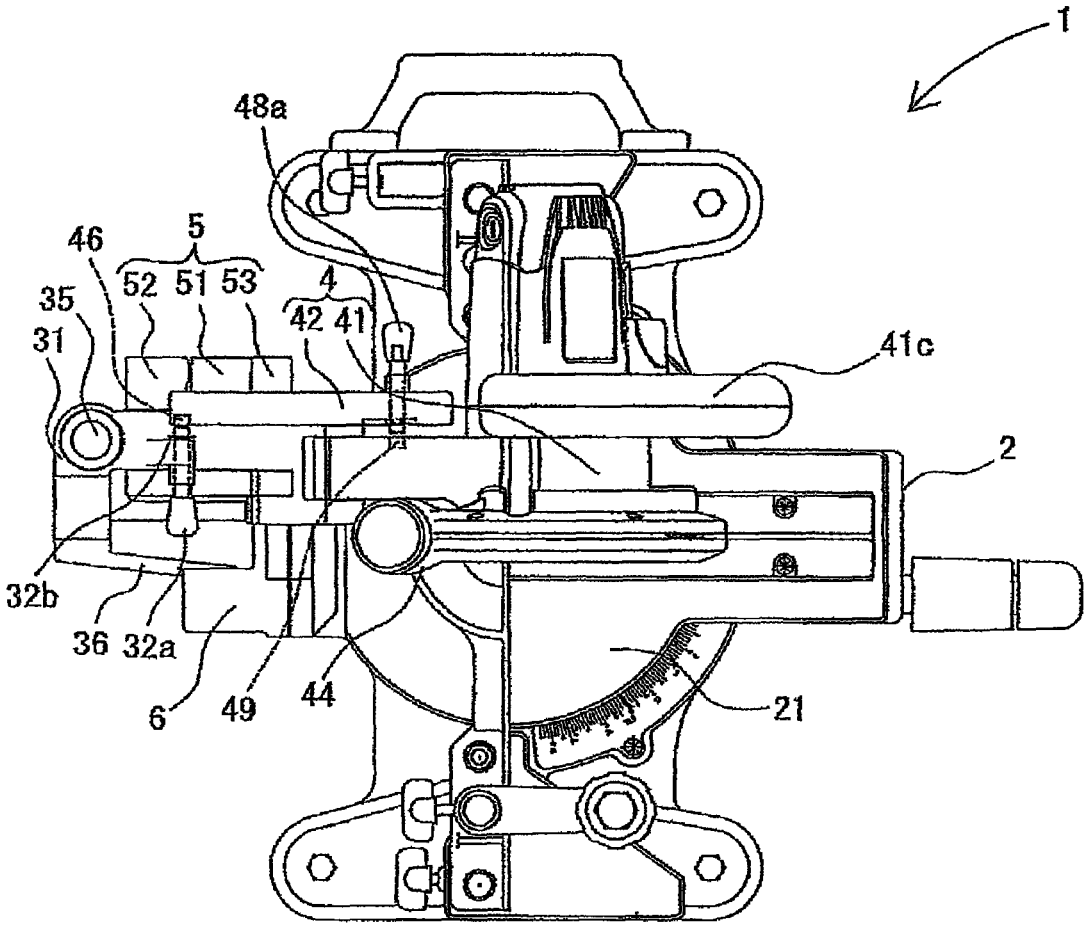
FIG. 4 is a top view of the whole structure of the slide-type cutting machine.
Figure 5:
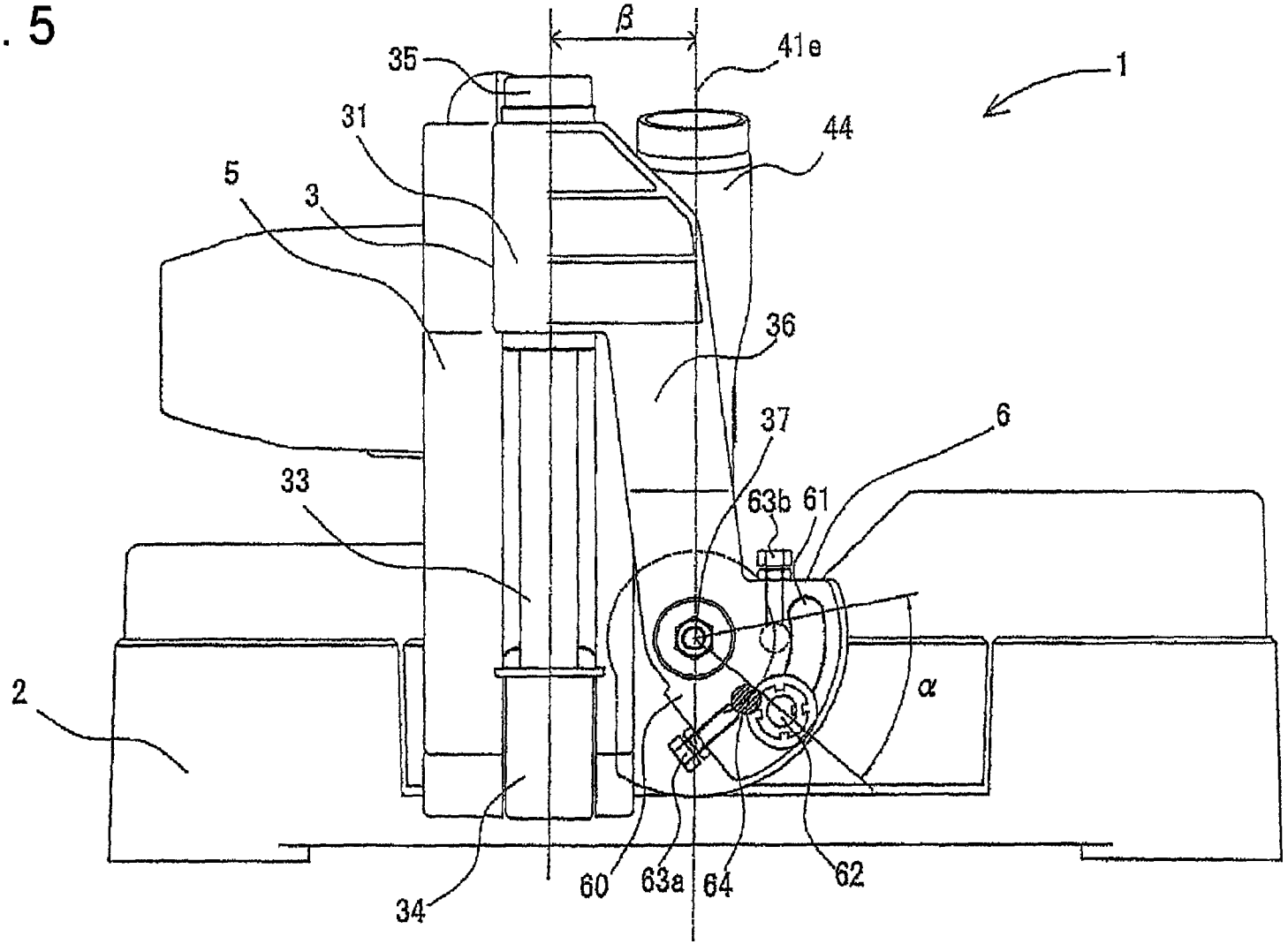
FIG. 5 is a back view showing a tilt mechanism of the linear guide unit of the slide-type cutting machine.
Figure 6:
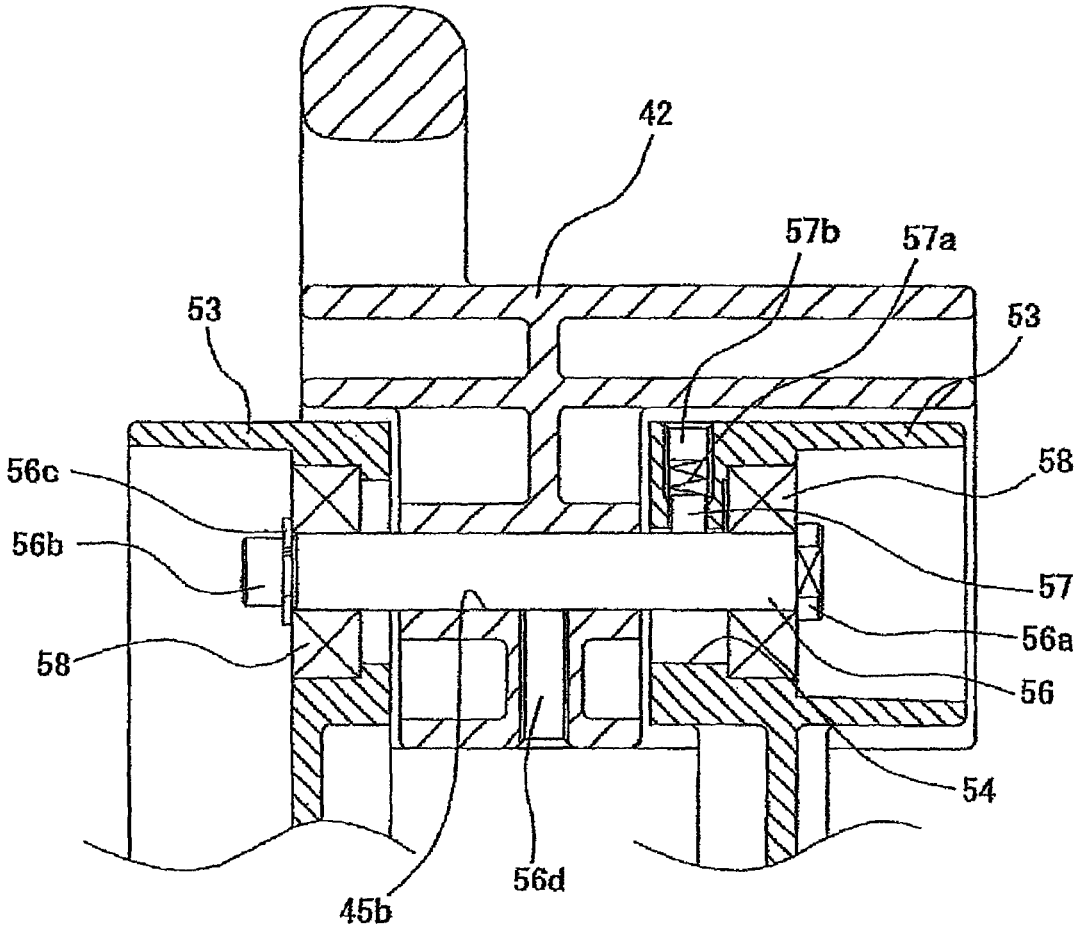
FIG. 6 is a section view taken along the line A-A in FIG. 1.

FIG. 1 is a side view showing the whole structure of the slide-type cutting machine. FIG. 2 is a side view showing a state in which the cutting section is moved to the operator's side. FIG. 3 is an enlarged view showing the linkage means of the slide-type cutting machine. FIG. 4 is a top view of the whole structure of the slide-type cutting machine. FIG. 5 is a back view showing a tilt mechanism of the linear guide unit of the slide-type cutting machine. FIG. 6 is a section view taken along the line A-A in FIG. 1.

Incidentally, for easier explanation, the right side of the drawings FIGS. 1 and 2 indicates the front of the cutting machine and the left side indicates the rear of the cutting machine. In the description below, the inner structure of the cutting section is identical with that of a general slide-type cutting machine and therefore only a simple description is given here.

The slide-type cutting machine shown in FIG. 1 comprises a base 2 provided with a plane 21 on which a workpiece such as wood is placed, a linear guide unit 3 mounted to the rearward of the base 2, a linkage means 5 including a Scott Russell mechanism which connects the linear guide unit 3 and a cutting section 4, and the cutting section 4 including a blade 41*a*.

As shown in FIG. 4, the cutting section 4 has a housing in a confronted fashion so as to include a driving member such as a motor therein. Further, as shown in FIG. 1, the cutting section 4 includes a blade portion 41 having a blade 41*a* secured thereto and a holding portion 42 secured to the rearward of the blade portion 41 through a swing shaft 47 so as to allow the blade 41*a* to swing around a swing shaft 47 as a pivot. Incidentally, as shown in FIGS. 3 and 4, such swing mechanism for vertically swinging the blade 41*a* around the swing shaft 47 as a pivot can be fixed by a swing stopper 48*a*, which is secured to the holding portion 42 not to be detached, in a manner that the swing stopper 48*a* is inserted through a swing fixing hole 48 formed in the holding portion 42 and through a blade portion fixing hole 49 formed in the blade portion 41. In addition, the blade portion 41 has a handle 41*c* for the operator to hold the cutting machine to make the cutting section 4 linearly move back and forth while he cuts and works a workpiece. Further, the handle 41*c* has a switch 41*d*. While holding the handle 41*c*, the operator presses the switch 41*d* to actuate the motor linked to the blade 41*a*, thus performing the cut and work operation.

The blade 41*a* is secured to the blade portion 41 by means of a fixing bolt 41*b*. The operator may select a blade suitable for the type of workpiece by removing and mounting the fixing bolt 41*b*. In the like manner, a worn blade 41*a* can be easily replaced with a new one by removing and securing the fixing bolt 41*b*.

Further, at the rear side of the blade portion 41 is located a dust collecting tube 44, an open end of which may be provided with a dust collecting bag so as to collect cut scraps and the like produced due to cutting workpiece. Here, as shown in FIGS. 1 and 4, since the center axis of the dust collecting pipe 44 is directed along the tangential line of the blade 41*a*, the cut scraps or the like scattered due to rotation of the blade 41*a* can be efficiently collected. With an additional member like a sucking device mounted to the dust collector 44, the dust-collecting action could be enhanced.

At the upper side of the holding portion 42 is located a carry handle 43. When carrying the slide-type cutting machine 1 of this embodiment, the operator can easily carry the cutting machine by holding the carry handle 43.

The rear of the carry handle 43 is provided with a first cutting section fixing hole 46. The position of the holding portion 42 (cutting section 4) can be fixed on the side of the linear guide unit 3 in the manner that a fixing pin 32*a* is inserted through the first cutting section fixing hole 46 and through a second cutting section fixing hole 32 formed in the first slide holder 31, so that the slide mechanism of the cutting section can be fixed. Incidentally, as shown in FIG. 4, a stopper ring 32*b* is secured to the fixing pin 32*a*. By the engagement of the stopper ring 32*b* with the linear guide unit 3, the fixing pin 32*a* is secured not to be removable from the first slide holder 31 and not to drop off from the second cutting portion fixing hole 32. Thus, it is unnecessary to take account of accommodation of the fixing pin 32*a* in a case when the cutting machine is not fixed, and it is possible to prevent the fixing pin 32*a* from missing.

At the time of carrying the slide-type cutting machine 1 of the invention, it is possible to safely carry the slide-type cutting machine 1 by holding the carry handle 43 without fixing the blade portion 41 by the swing stopper 48*a* because the carry handle 43 can be fixed with regard to the base 2 in the manner that the cutting unit 4 is fixed using the fixing pin 32*a* as mentioned above.

Next, the linear guide unit 3 is described with reference to the drawings FIGS. 1 to 3.

As shown in FIG. 1, the linear guide unit 3 includes a slide shaft 33, the first slide holder 31 provided with a sliding hole 31*a*, through which the slide shaft 33 is slidably inserted, and a second slide holder 34 located at the lower end of the slide shaft 33.

As shown in FIG. 3, the first slide holder 31 is provided with a slide hole 31*a*, through which the slide shaft 33 is slidably inserted, and mounted to the rear end of the base 2 to be inclinable. The first slide holder 31 is also provided with a first slide holder link hole 31*b* to rotatably secure a second link 52 so that the first slide holder link hole 31*b* accepts one end of the second link 52.

The slide shaft 33 has a rod shape and is inserted in the slide hole 31*a* slidably in a direction perpendicular to the moving direction of the cutting section 4. Further, at the lower end of the slide shaft 33 is located a second slide holder 34. The slide holder 33 is fixed to the second slide holder 34 with the lower end thereof pressed into the second slide holder. The second slide holder 34 moves upward together with the slide shaft 33 and as shown in FIG. 2, the upward movement of the slide shaft 33 is restricted by the abutment of the lower end of the first slide holder 31 against the upper end of the second slide holder 34.

The upper end of the peripheral surface of the slide shaft 33 may be formed with a chamfering portion extending in the axial direction of the slide shaft, and a profile of the slide hole 31*a* may have almost a shape of 'D' in order to correspond to the chamfering portion. With such formation of the slide shaft 33 and the slide hole 31*a*, easy positioning of the slide shaft 33 is possible at the time of inserting the slide shaft 33 into the slide hole 31*a*. Also, at the time of assembling the linkage means 5 described later, easy and accurate alignment of those members is possible.

In addition, the lower end of the peripheral surface of the slide shaft 33 may also be formed with a chamfering portion extending in the axial direction of the slide shaft, and the second slide holder 34 may be provided with a press-fit hole having a shape of 'D' in order to correspond to the chamfering portion of the lower end of the slide shaft 33. With such formation of the slide shaft 33 and the press-fit hole, easy positioning of the slide shaft 33 is possible at the time of press-fitting the slide shaft 33 into the second slide holder, and at the time of assembling the linkage means 5 described later, easy and accurate alignment of those members is possible.

At the upper end of the slide shaft 33 is located a stopper 35 and as shown in FIG. 1, the downward movement of the slide shaft 33 is restricted by the abutment of the upper end of the first slide holder 31 against the stopper 35.

The second slide holder 34 is provided with a second slide holder link hole 34*a* for securing a first link 51 and a second slide holder auxiliary link hole 34*b* for securing an auxiliary link 53. The first link 51 and the auxiliary link 53 are rotatably connected to the second slide holder link hole 34*a* and to the second slide holder auxiliary link hole 34*b*, respectively.

Next, the linkage means 5 is described with reference to FIG. 3.

The linkage means 5 includes the first link 51, the second link 52 and the auxiliary link 53. The first link 51 has one end rotatably connected to a first holding section link hole 45*a* formed in a holding section 42 and the other end rotatably connected to the second slide holder link hole 34*a* formed in the second holder 34. The second link 52 has one end rotatably connected to the slide holder link hole 31*b* formed in the first slide holder 31 and the other end rotatably connected to a link connection hole 55 formed in the first link 51. The auxiliary link 53 has one end rotatably connected to a second holding section link hole 45*b* formed in the holding section 42 and the other end rotatably connected to the second slide holder auxiliary link hole 34*b* formed in the second slide holder 34, and the auxiliary link 53 is disposed parallel with the first link 51.

Next, connecting manners of the links are described with reference to FIG. 6. As the connecting manners of the first link 51, the second link 52, and the auxiliary link 53 are identical, the connecting manner of the auxiliary link 53 is described as an example.

The auxiliary link 53 is provided with a link hole 54, and a shaft 56 is inserted in the link hole 54 and a holding section link hole 45*b* to be secured by bolt fixing.

A rotating portion of the auxiliary link 53 having the shaft 56 as a rotation axis is provided with a bearing 58 for reducing a rotating friction. The bearings 58, 58 are fastened by a shaft fixing bolt 56*b* using a shaft head 56*a* and a washer 56*c*. By pushing a ball (not shown) in the bearing 58 to one of the longitudinal directions of the shaft 56, the bearing is free of axial play, preventing backlash. The link hole 54 is provided on its inner periphery with a rotation control member 57 forced to the radial direction of the shaft 56. The rotation control member 57 is formed of silicone rubber, and forced to the radial direction of the shaft 56 by a spring 57*a* as an elastic body. Since the force applied by the spring 57*a* can be controlled by fastening an adjustment screw 57*b*, the rotation controlling power can be controlled by adjusting the frictional resistance between the rotation control member 57 and the shaft 56. Since the rotation control member 57 prevents the auxiliary link 53 from abruptly rotating around the shaft 56 as the rotation axis, it is possible to prevent the cutting section 4 from abruptly running when the operator takes off the hand from the cutting section.

To be noted, the rotation control member 57 may be well if it is provided at least at one of the links, in other words, all the links are not necessarily provided with the rotation control member.

Further, a shaft fixing screw 56*d* is secured to the holding section link hole 45*b* formed in the holding section 42 so as to abut against the shaft 56, preventing a radial backlash of the shaft 56 and the holding section 42. Being free of radial backlash of the shaft 56 and the holding section 42, and free of radial backlash of the bearing between the shaft 56 and the auxiliary link 53, high accurate movement of the auxiliary link 53 is possible.

The linkage means 5 constitutes the Scott Russell mechanism in cooperation with the linear guide unit 3. The cutting section 4 can move linearly without swinging vertically owing to the linkage means 5.

Further, the side face of the first link 51 is provided with a reinforcement portion 55*a* for increasing rigidity of a link connection hole 55.

The auxiliary link 53 serves to allow the cutting section 4 to keep its posture while moving linearly. The upper end face of the auxiliary link 53 is provided with a recess portion 53*a* so as not to come in contact with the reinforcement portion 55*a* formed in the first link 51.

With such structure of the slide-type cutting machine 1, as shown in FIGS. 1 and 2, the cutting section 4 can be moved linearly with regard to the base 2, from a natural state as shown in FIG. 1, till a state in which the slide shaft 33 is moved to the upward position and the linkage means 5 is stretched out, as shown in FIG. 2.

Next, manner of securing the linear guide unit 3 to the base 2 is described with reference to FIG. 5.

As shown in FIG. 5, the linear guide unit 5 is mounted to the base to be rotated around the bolt 37 as a rotation axis. Namely, the linear guide unit 5 is secured to the base 2, with a securing arm 36 extending downward from the lower end of the first slide holder 31 secured to the base 2 by fastening a pin 62.

Further, a securing portion of the linear guide unit 3 is provided with the tilting mechanism 6. The tilting mechanism 6 includes a tilting plate 60 located at a tip of the securing arm 36, an arc-shaped groove 61 formed in the tilting plate 60, and the pin 62 engaged with the inner periphery of the arc-shaped groove 61. Fastening the pin 62 allows the tilting plate 60 to be fixed to the base 2 through an operation of rotating a knob 65 linked with the pin 62.

The linear guide unit 3 rotates around the bolt 37 as the center and the pin 62 engaged with the inner periphery of the arc-shaped groove 61 restricts a rotation range of the linear guide unit 3. The operator may tilt the linear guide unit 3 to a desirable tilt position, and then rotate the knob 65 to fasten the pin 62, thus allowing the linear guide unit 3 to be fixed at the desirable tilt angle.

The tilting plate 60 is provided with adjustment bolts 63*a* and 63*b*, and the base 2 is provided with a stopper 64. The stopper 64 and the adjustment bolt 63*a* abut against each other to make the linear guide unit 3 vertically stand on the base 2, and the stopper 64 and the adjustment bolt 63*b* restrict a tilt range of the tilting plate 60. By adjusting the adjustment bolts 63*a* and 63*b*, the degree of verticality of the linear guide unit 3 with respect to the base 2 can be controlled and the tilt range of the tilting mechanism 6 can be controlled within the range of the groove 61.

The tilting mechanism 6 allows the linear guide unit 3 to tilt at a predetermined angle $\alpha$ with respect to the base 2. Tilting of the linear guide unit 3 allows the cutting section 4, which is connected with the linear guide unit 3 through the linkage means, to be tilted, thus allowing a workpiece to be cut slantwise with respect to the work plane 21. In this embodiment, the linear guide unit 3 is designed to tilt at an angle in the range of 45° to 90°.

As mentioned above, since the linear guide unit 3 is secured to the base 2 through the tilting mechanism 6, the cutting section 4 can be tilted and fixed at an angle in a predetermined range with respect to the work plane 21, on which a workpiece is placed. Thus, the workpiece can be cut at a desirable angle. Further, since the tilting plate 60 is substantially fan-shaped, the tilting plat 60 does not interfere with the linear guide unit 3. Also, since the linear guide unit 3 can be located laterally to the tilting plate 60, decreasing the size of the slide-type cutting machine 1.

Further, as shown in FIG. 5, the linear guide unit 3 and the linkage means 5 are located at an offset position vertically off from a plane including a blade plane 41*e* as a rotating plane of the blade 41*a* by an offset of $\beta$. With such arrangement of the linear guide unit 3 and the linkage means 5 vertically offset from the plane including the blade plane 41*e*, the size of the slide-type cutting machine 1 can be decreased, the center axis of the dust collecting tube 44 on a plane substantially flush with the plane including the blade plane 41*e* dose not intersect the linear guide unit 3 or the linkage means 5, and a dust-collecting bag to be mounted to the open end of the dust collecting tube 44 does not obstruct the movement of the cutting section and the action of the linear guide unit 3 and the linkage means 5, thus permitting smooth movement of the cutting section 4. In addition, since the dust collecting tube 44 is located on the rearward side of the blade section 41, at the offset position free from interfering with the linkage means 5 and the holding section 42, the size of the slide-type cutting machine 1 can be decreased particularly in the fore-and-aft direction. While, in this embodiment, the linear guide unit 3 and the linkage means 5 are vertically offset from the plane including the blade plane 41*e* as the rotating plane of the blade 41*a* by the offset of β, one of the linear guide unit 3 and the linkage means 5 may be located at the offset position vertically off from the plane including the blade plane 41*e* as the rotating plane of the blade 41*a*.

To be noted, the present invention is not necessarily limited to the above embodiment but may be carried out in various manners of embodiment. While, in this embodiment, one example where the auxiliary link is located at the lower side of the first link is described, the auxiliary link may well be located at the upper side of the first link. Also, while one example of fixing the holding section in which the holding section and the first slide holder are engaged with each other is described, the slide shaft and the first slide holder may well be fixed to each other. Further, while, in this embodiment, an embodiment where the rotation control member is mounted to the auxiliary link is described, the rotation control member may well be mounted to the first link and may also be mounted to the second link. Further, the rotation control member is not necessarily provided to one spot but also may be provided to two or more spots of the links. Furthermore, the embodiment in which the rotation control member is forced by a spring is described, the rotation control member may well be formed of a material having elasticity so as to be forced by resilience of the elastic material.

The invention claimed is:

1. A slide-type cutting machine, comprising:

a base having a work plane on which a workpiece is placed;

a linear guide unit secured to the base; and a linkage means secured to a cutting section having a blade, the linear guide unit and the linkage means constituting a Scott Russell mechanism in cooperation with each other and guiding a linear movement of the cutting section, wherein the linear guide unit includes:

a slide shaft moving in a vertical direction, perpendicular to the moving direction of the cutting section, by its own weight thereof;

a first slide holder for guiding the movement of the slide shaft; and a second slide holder located at a lower end of the slide shaft along the vertical direction and restricting the movement of the slide shaft by abutting against the first slide holder, and the linkage means includes:

a first link having one end connected to the cutting section and the other end connected to the second slide holder; and a second link having one end connected to the first slide holder and the other end connected to the first link.

2. The slide-type cutting machine according to claim 1, including an auxiliary link having one end connected to the cutting section and the other end connected to the second slide holder.

3. The slide-type cutting machine according to claim 2, including a slide stopper located at the upper end of the slide shaft to restrict the movement of the slide shaft by abutting against the first slide holder.

4. The slide-type cutting machine according to claim 2, wherein at least one of the linear guide unit and the linkage means is located at a position offset laterally with respect to a plane including a rotating plane of the blade.

5. The slide-type cutting machine according to claim 1, wherein the cutting section includes a blade portion having a blade, and a holding section for connecting the blade portion to the linkage means, and the holding section is provided with a carry handle.

6. The slide-type cutting machine according to claim 1, including a slide stopper located at the upper end of the slide shaft to restrict the movement of the slide shaft by abutting against the first slide holder.

7. The slide-type cutting machine according to claim 6, wherein at least one of the linear guide unit and the linkage means is located at a position offset laterally with respect to a plane including a rotating plane of the blade.

8. The slide-type cutting machine according to claim 6, wherein the cutting section includes a blade portion having a blade, and a holding section for connecting the blade portion to the linkage means, and the holding section is provided with a carry handle.

9. The slide-type cutting machine according to claim 1, wherein at least one of the linear guide unit and the linkage means is located at a position offset laterally with respect to a plane including a rotating plane of the blade.

10. The slide-type cutting machine according to claim 9, wherein the linear guide unit and the linkage means are located so as not to intersect the center axis of a dust collecting tube mounted to the cutting section.

11. The slide-type cutting machine according to claim 9, wherein the cutting section includes a blade portion having a blade, and a holding section for connecting the blade portion to the linkage means, and the holding section is provided with a carry handle.

12. The slide-type cutting machine according to claim 1, wherein the cutting section includes a blade portion having a blade, and a holding section for connecting the blade portion to the linkage means, and the holding section is provided with a carry handle.

13. The slide-type cutting machine according to claim 1, wherein the cutting section includes a blade portion having a blade, and a holding section for connecting the blade portion to the linkage means, and the holding section is provided with a carry handle.

14. The slide-type cutting machine according to claim 1, wherein the slide shaft is moved in the vertical direction by a weight of the second slide holder.

15. The slide-type cutting machine according to claim 1, wherein after the cutting section is moved in a direction away from the linear guide unit and released, the cutting section moves in a direction toward the linear guide unit due a downward movement of the slide shaft and the second slide holder in a direction toward the base.

16. The slide-type cutting machine according to claim 1, wherein the second slide holder is located at the lower end of the slide shaft with respect to a position at which the linear guide unit is secured to the base.

* * * * *